US006683419B2

(12) United States Patent
Kriparos

(10) Patent No.: US 6,683,419 B2
(45) Date of Patent: Jan. 27, 2004

(54) ELECTRICAL CONTROL FOR AN LED LIGHT SOURCE, INCLUDING DIMMING CONTROL

(75) Inventor: Daniel J. Kriparos, Freehold, NJ (US)

(73) Assignee: Dialight Corporation, Farmingdale, NJ (US)

( * ) Notice: Subject to any disclaimer, the term of this patent is extended or adjusted under 35 U.S.C. 154(b) by 0 days.

(21) Appl. No.: 10/176,685

(22) Filed: Jun. 24, 2002

(65) Prior Publication Data

US 2003/0234621 A1 Dec. 25, 2003

(51) Int. Cl.[7] ..... G05F 1/00; H05B 37/02
(52) U.S. Cl. ..... 315/224; 315/291
(58) Field of Search ..... 315/224, 291, 315/246, 247, 297, 272, 307; 363/21.1, 21.11, 21.15, 21.18; 362/84, 545; G05F 1/00; H05B 37/02

(56) References Cited

U.S. PATENT DOCUMENTS 4,412,245 A * 10/1983 Kwok ..... 725/149
6,285,139 B1 * 9/2001 Ghanem ..... 315/291
6,400,102 B1 * 6/2002 Ghanem ..... 315/291
2002/0140379 A1 * 10/2002 Chevalier et al. ..... 315/291
2002/0176262 A1 * 11/2002 Tripathi et al. ..... 356/419

* cited by examiner

*Primary Examiner*—Don Wong
*Assistant Examiner*—Trinh Vo Dinh
(74) *Attorney, Agent, or Firm*—Oblon, Spivak, McClelland, Maier & Neustadt, P.C.

(57) ABSTRACT

A control for a light with an LED light source. The LED light source mimics an operation of an incandescent light source with respect to a dimming control. The LED light source includes at least one LED. A power source provides power to the at least one LED. A sensing element senses at least one of voltage and current at the at least one LED and outputs a feedback signal to the power source based on the sensed at least one of voltage and current. A control circuit is connected to the sensing element and controls the feedback signal output by the sensing element. That control circuit can control the feedback signal output by the sensing element to simulate a dimming operation of an incandescent light source.

9 Claims, 2 Drawing Sheets

ELECTRICAL CONTROL FOR AN LED LIGHT SOURCE, INCLUDING DIMMING CONTROL

BACKGROUND OF THE INVENTION

1. Field of the Invention

The present invention is directed to an electrical control for light emitting diode (LED) light sources, and particularly to an electrical control that can provide a dimming control of the LED light source to simulate a dimming operation in a conventional incandescent light source.

2. Background of the Invention

Light emitting diodes (LEDs) are becoming increasingly common as light sources for various reasons. In comparison with a conventional incandescent lamp, LEDs provide a significantly more energy efficient light source than an incandescent lamp. Further, LEDs have significantly longer lifetimes than incandescent lamps. LED light sources can include any number of individual light emitting diodes connected in series, in parallel, or a combination of in series and in parallel. By combining enough individual LEDs, an LED light source can equal or exceed an output of an incandescent film based light source.

However, LEDs have certain different electrical properties from incandescent light sources, which in certain instances may make it difficult to substitute an LED light source for a conventional incandescent light source.

SUMMARY OF THE INVENTION

Accordingly, one object of the present invention is to provide a control for and a light with an LED light source that makes the LED light source more closely mimic the operation of an incandescent light source, to make the LED light source a more viable replacement for an incandescent light source.

One more specific object of the present invention is to provide a dimming control for an LED light source that mimics the dimming operation of an incandescent light source.

To achieve the above and other objects, in non-limiting features the present invention is directed to an LED light source and a control for an LED light source. The LED light source includes at least one LED. A power source provides power to the at least one LED. A sensing element senses at least one of voltage and current at the at least one LED and outputs a feedback signal to the power source based on the sensed at least one of voltage and current. Further, a control circuit is connected to the sensing element and controls the feedback signal output by the sensing element. That control circuit can control the feedback signal output by the sensing element to simulate a dimming operation of an incandescent light source.

DESCRIPTION OF THE PREFERRED EMBODIMENTS

The applicant of the present invention has recognized that one potential problem with replacing conventional incandescent light sources with LED light sources is that an LED light source differs in its dimming operation from that in an incandescent light source. This is a particular problem when LED light sources are used to replace incandescent light sources as the incandescent light sources bum out, which results in both LED light sources and incandescent light sources operating in the same system. As one concrete example, runway lights, taxiway lights, etc. at airports conventionally utilize incandescent light sources. If an airport operator wishes to switch to LED light sources, the airport operator would like to do so over time as the conventional incandescent light sources burn out, for the obvious economic reason to avoid having to replace every incandescent lamp with an LED light source at the same time, and to get the maximum usage out of the existing incandescent light sources. In such a situation both LED light sources and incandescent light sources will be part of the lighting system at the same time.

The applicant of the present invention has recognized that an LED light source and an incandescent light source have different dimming properties. In this instance dimming is defined as reducing the output brightness of a light source by varying the input power. The different dimming properties make it difficult to replace the incandescent light sources with the LED light source.

Figure 1:
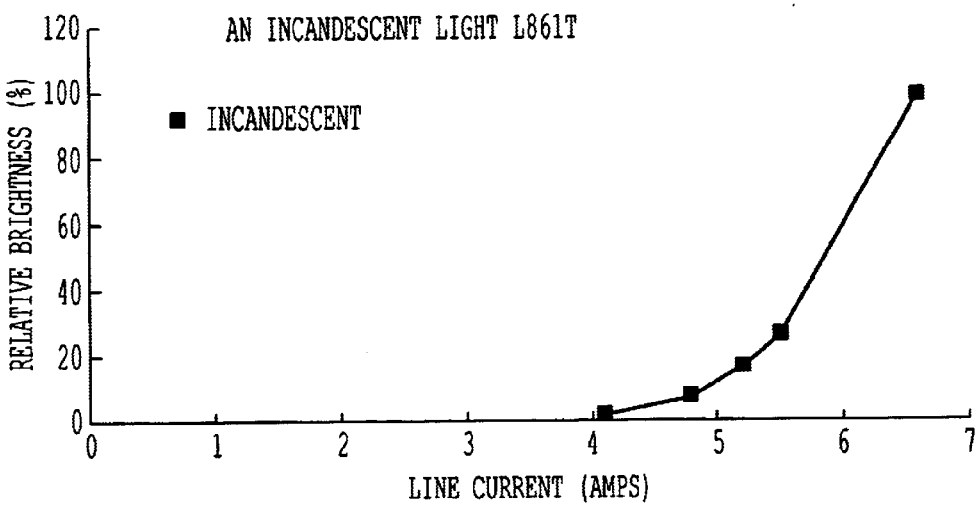
FIG. 1 shows the dimming property of a conventional incandescent light source.

FIG. 1 shows the dimming property of a conventional incandescent light source, in this case an incandescent light L861T manufactured by Dialight Corporation. As shown in FIG. 1, the brightness of the noted incandescent light source relative to input power has an exponential function of $e^x$, which is typical for all incandescent light sources. In contrast to such a brightness control, i.e. dimming property, of an incandescent lamp, a brightness control of an LED light source is substantially linear.

Figure 2:
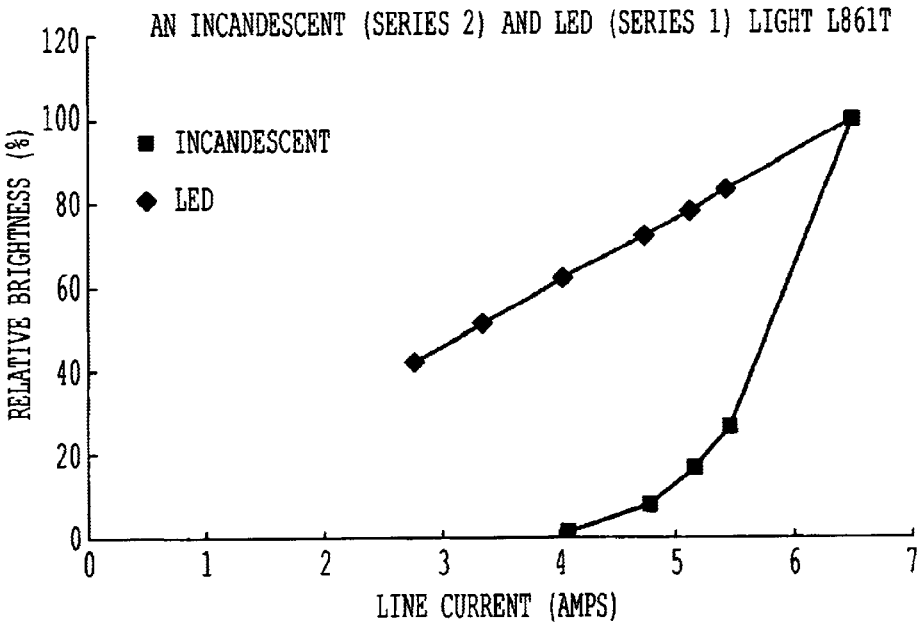
FIG. 2 shows a comparison of the relative brightness of an LED light source versus input power in comparison with the non-linear brightness control of an incandescent light source shown in FIG. 1.

FIG. 2 shows a comparison of the relative brightness of an LED light source versus input power in comparison with the non-linear brightness control of an incandescent light source shown in FIG. 1. As an LED light source has a substantially linear brightness control, in comparison with the exponential brightness control of a conventional incandescent lamp, if an LED light source is introduced among a string of incandescent lights, such as runway lights, taxiway lights at an airport, etc., the LED light source will be noticeably brighter than its incandescent counterparts that are part of the same circuit.

One feature of the present invention is to electronically control the light output of an LED light source such that the LED light characteristics emulate incandescent light outputs when being dimmed. The benefit of incorporating such a feature is to make the introduction of LED light sources into systems that also have incandescent light sources transparent to an end user.

Figure 3:
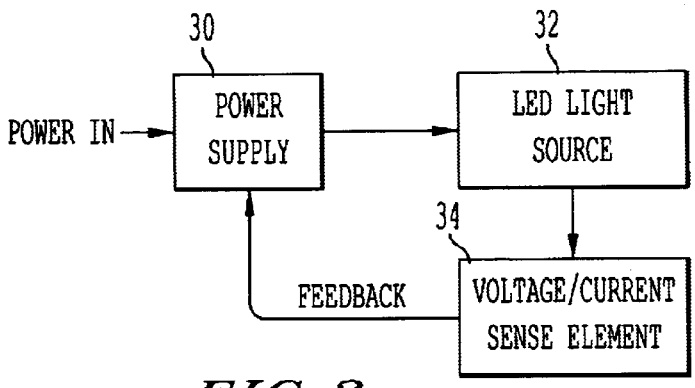
FIG. 3 BACKGROUND ART
FIG. 3 is block diagram of a background power source system used to provide power to LEDs from a given power source.

FIG. 3 is a block diagram of a background power source system used to provide power to LEDs from a given power source.

As shown in FIG. 3, a power supply 30 provides power to an LED light source 32. That power supply 30 typically performs power conversion of AC to DC or DC to DC and has a linear or switchmode topology The LED light source 32 can be as simple as a single LED, but will typically include plural LEDs connected in a series string, and can include plural LED strings connected in parallel. A voltage/current sense element 34 is connected to the LED light source 32. The sense element 34 senses at least one of the voltage or current provided to the LED light source 32. The sense element 34 provides a feedback signal to the power supply 30 based on the sensed voltage and/or current. The sense element 34, in addition to monitoring voltage and/or current, can also take the form of an element which senses light intensity, such as a photo detector.

In one specific non-limiting example of an embodiment of the sense element 34, the sense element 34 can use a resistive element to sense current through the LEDs. Knowing the voltage across the resistive element would thereby provide the current information. If the sense element 34 senses light intensity, the sense element 34 could take the form of a photodetector with an analog output voltage level proportional to the detected light intensity directed at a collector. A photodetector could also be complimented by a bandpass filter with an associated gain. The purpose of such a bandpass filter would be to block out ambient artificial light while gain aspects would be used to increase an output signal of the photodetector to useable voltage levels. Other forms of a sense element 34 could of course also be implemented.

The power supply 30 will typically use the feedback signal from the sense element 34 to provide either a constant current or constant voltage to the LED source 32. By varying the feedback signal, more or less current can be sourced to the LED light source 32, to control the brightness output of the LED light source 32.

The background control circuit shown in FIG. 3 provides a dimming control for an LED as shown in FIG. 2. As shown in FIG. 2 that dimming control for the LED is linear and is significantly different than a dimming control for an incandescent light source, which as discussed above is exponential, thereby making it difficult to incorporate LEDs in systems also including incandescent light sources.

Figure 4:
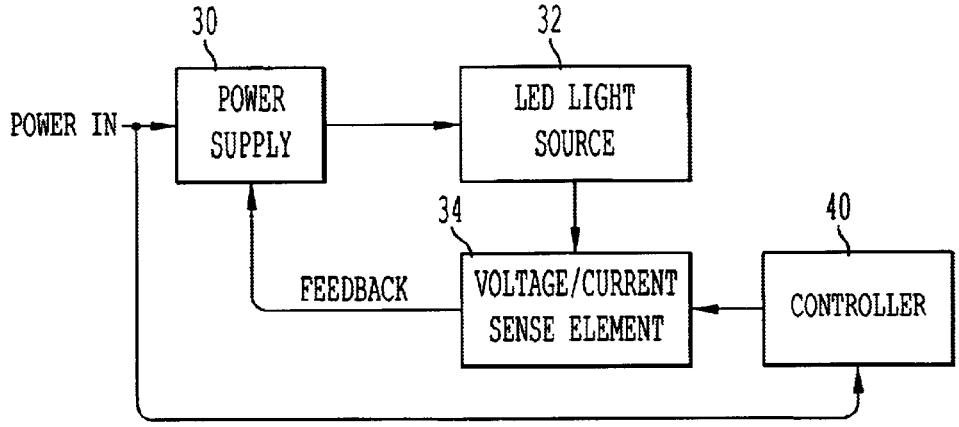
FIG. 4 shows the modified power control system of the present invention.

In view of the drawbacks of the conventional power supply circuitry of FIG. 3, the applicant of the present invention has realized the modified power control system as shown in FIG. 4.

The power control system of FIG. 4 is identical to that of FIG. 3 except that an additional controller 40 is provided. That controller 40 receives the input power to the power supply 30 and controls the sense element 34 that outputs the feedback signal. In that way, the controller 40 essentially controls the feedback signal output from the sense element 34. The controller 40 can typically be a reduced instruction set controller (RISC) or a microcontroller.

The controller 40 operates to modulate the feedback signal output from the sense element 34. The controller 40 can modulate that feedback signal by either an amplitude modulation (AM) or a pulse width modulation (PWM). In the amplitude modulation the amplitude of the feedback signal would be modulated, and thereby the LED light source 32 responds with a corresponding change in light intensity based on the amplitude modulation. In a pulse width modulation, by varying the feedback signal and varying pulse widths, the LED light source 32 will respond by toggling on and off at a rate determined by the controller 40. That control of the toggling on and off of the LED light source 32 thereby controls the light intensity output by the LED light source 32.

The controller 40 in a preferred but non-limiting embodiment can be a software programmable device with any number of analog/digital I/O ports, those ports controlling the feedback signal output from the sense element 34. In the case of a pulse width modulation control being executed, the pulse frequency and duty cycle are determined in software in the controller 40.

As a non-limiting example, the controller 40 can take the form of a microcontroller, such as a model 12C671 manufactured by Microchip. That particular microcontroller is an 8-bit controller with basic I/O and A/D capabilities. In such a microcontroller the I/O portal is used for switching in various resistor values to change gain settings and the A/D capabilities are used to sense voltages and currents required by the feedback loop. Of course other forms of the microcontroller 40 are clearly within the scope of the present invention.

The operation of the controller 40 is essentially to change the output properties of the LED light source 32 to simulate those of a conventional incandescent light source. That is, the controller 40 will take the linear brightness control of the LED light source 32 and convert it into an exponential brightness control such as in a conventional incandescent light source.

To achieve such an operation, the controller 40 calculates the root mean square (RMS) value of the power source, and based on that value adjusts the feedback signal, to thereby adjust the power supplied to the LED light source 32.

To further enhance operations of the system, and particularly to increase the system immunity to ambient electrical noise, the controller 40 can enhance an A/D conversion in the following way. In an embodiment in which the sense element 34 is sensing either current or voltage, although the system operates to read DC voltages and currents, every A/D conversion can be performed 100 times sequentially with the results stored in the memory. At the end of the 100 data acquisition cycle an average of the sum of the squares can be performed. In that way, taking 100 samples and averaging them together can yield an accuracy of about 95%, which is superior than taking a single A/D conversion operation and assuming that the converted value is accurate.

As the one example discussed above, LED light sources can be used in airport runway lights or taxiway lights. Such lights conventionally require either three or five steps of dimming control. Examples of the five steps of dimming control are the five block points shown in FIG. 1.

In one operation, the controller 40 stores those five dimming points in a memory element therein, such as a nonvolatile memory portion. Then, as shown in the operation in FIG. 4, the controller 40 determines the required output LED current based on the input RMS power. The controller 40 can then vary the feedback signal to give a piecewise linear approximation (PWL) of the different points shown in FIG. 1.

Figure 5:
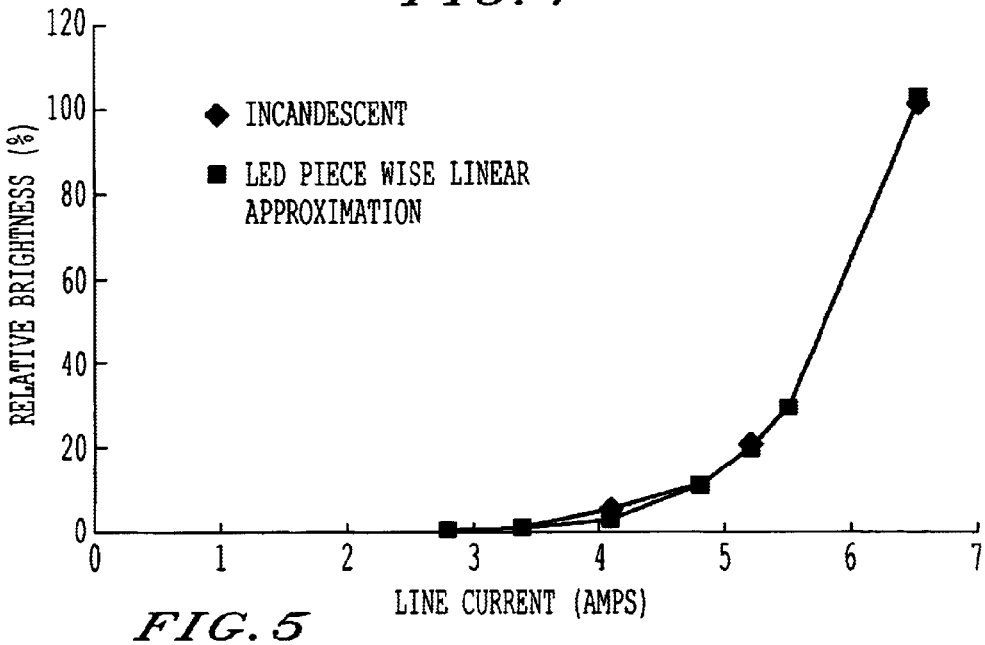
FIG. 5 shows the LED piecewise linear approximation can mimic the dimming control of the conventional incandescent light.

The result is shown in FIG. 5. As shown in FIG. 5 the LED piecewise linear approximation can mimic the dimming control of the conventional incandescent light.

Such an operation in the present invention provides the benefits that an LED light source can be incorporated into existing incandescent light source systems and have the same dimming effect. As a result, the introduction of LED light sources into the conventional incandescent light source systems is transparent to end users.

Obviously, additional modifications and variations of the present invention are possible in light of the above teachings. It is therefore to be understood that within the scope of the appended claims, the present invention can be practiced otherwise than as specifically described herein.

What is claimed is:

1. A light, comprising:

(a) a light source including at least one LED;

(b) a power source configured to provide power to said at least one LED;

(c) a sensing element configured to sense at least one of voltage and current at said at least one LED, and configured to output a feedback signal to said power source based on the sensed at least one of voltage and current; and (d) a control circuit connected to said sensing element and configured to control the feedback signal output by said sensing element, wherein said control circuit stores data points of a dimming operation of an incandescent light source and controls the feedback signal output by said sensing element to simulate the dimming operation of the incandescent light source based on the stored data points.

2. The light according to claim 1, wherein said sensing element provides an amplitude modulation of the output feedback signal.

3. The light according to claim 1, wherein said sensing element provides a pulse width modulation of the output feedback signal.

4. A light, comprising:

(a) light source means for outputting light, and including at least one LED;

(b) power source means for providing power to said at least one LED;

(c) sensing means for sensing a power property at said at least one LED, and for outputting a feedback signal to said power source based on the sensed power property; and (d) control means connected to said sensing means for controlling the feedback signal output by said sensing means, wherein said control means stores data points of a dimming operation of an incandescent light source and controls the feedback signal output by said sensing means to simulate the dimming operation of the incandescent light source based on the stored data points.

5. The light according to claim 4, wherein said sensing means provides an amplitude modulation of the output feedback signal.

6. The light according to claim 4, wherein said sensing means provides a pulse width modulation of the output feedback signal.

7. A method for controlling a light emitting diode (LED) circuit including a light source with at least one LED and a power source configured to provide power to said at least one LED, comprising:

(a) sensing at least one of voltage and current at said at least one LED;

(b) outputting a feedback signal to said power source based on the sensed at least one of voltage and current; and (c) controlling the output feedback signal, wherein said controlling operation utilizes stored data points of a dimming operation of an incandescent light source and controls the feedback signal to simulate the dimming operation of the incandescent light source based on the stored data points.

8. The method for controlling a LED circuit according to claim 7, wherein said sensing step provides an amplitude modulation of the output feedback signal.

9. The method for controlling a LED circuit according to claim 7, wherein said sensing step provides a pulse width modulation of the output feedback signal.

* * * * *